US005622072A

United States Patent [19]

Benz

[11] Patent Number: 5,622,072

[45] Date of Patent: Apr. 22, 1997

[54] LEVELLING MACHINE FOR LEVELLING SHEET METAL AND STRIP

[75] Inventor: Willi Benz, Neuss, Germany

[73] Assignee: SMS Schloemann-Siemag Aktiengesellschaft, Düsseldorf, Germany

[21] Appl. No.: 430,733

[22] Filed: Apr. 28, 1995

[30] Foreign Application Priority Data

Apr. 29, 1994 [DE] Germany ..... 44 15 048.2

[51] Int. Cl.[6] ..... B21D 1/02

[52] U.S. Cl. ..... 72/163

[58] Field of Search ..... 72/160, 163, 165, 72/164

[56] References Cited

U.S. PATENT DOCUMENTS

| | | | |
|---|---|---|---|
| 1,890,342 | 12/1932 | Sutton | 72/163 |
| 1,968,389 | 7/1934 | Guthrie | 72/163 |
| 2,949,147 | 8/1960 | Maust | 72/163 |
| 3,078,909 | 2/1963 | Maust | 72/163 |
| 3,327,509 | 6/1967 | Roesch | 72/163 |

FOREIGN PATENT DOCUMENTS 4200922 7/1993 Germany .

*Primary Examiner*—Daniel C. Crane
*Attorney, Agent, or Firm*—Friedrich Kueffner

[57] ABSTRACT

A levelling machine for levelling or flattening sheet metal or strip includes upper and lower levelling rolls which are arranged offset relative to each other and which are supported over their length by back-up rolls which, in turn, are supported and arranged in roll stands. The levelling machine further includes intermediate rolls for driving the levelling rolls.

4 Claims, 4 Drawing Sheets

LEVELLING MACHINE FOR LEVELLING SHEET METAL AND STRIP

BACKGROUND OF THE INVENTION

1. Field of the Invention

The present invention relates to a levelling machine for levelling or flattening sheet metal or strip. The levelling machine includes upper and lower levelling rolls which are arranged offset relative to each other and which are supported over their length by means of back-up rolls which, in turn, are supported and arranged in roll stands.

2. Description of the Related Art

A levelling machine of this type has become known from DE 42 00 922 A1. The levelling machine includes upper and lower crossbeams for supporting the back-up rolls. For positioning the levelling rolls, the upper crossbeam is adjustable by means of adjusting cylinders relative to the lower crossbeam. In addition, the levelling rolls of this levelling machine are individually adjustable and individually driven and, for this purpose, are connected through universal joint shafts to a drive. Bearing support wedges and displaceable adjusting wedges which are each displaceable by means of, for example, a pressure medium cylinder, are provided in the lower and upper roll stand for adjusting individual levelling rolls, i.e., for raising or lowering the levelling rolls. Accordingly, the hydraulically operated wedge pairs used as adjusting members for the levelling rolls including the back-up rolls make it possible to remove certain upper and lower rolls from the levelling process and, thus, to adjust from levelling roll to levelling roll different and possibly asymmetrical graduations or spacings and, thus, varying lever conditions. As a result, smaller forces occur at the levelling rolls arranged with a greater degree of graduation as compared to the normal adjustment. These smaller forces make it possible to level thicker sheet metal or strip, wherein the thickness can be increased until the full force again occurs at each levelling roll.

It has been found that problems occur in levelling machines whose levelling rolls are driven individually when it is necessary to level high-strength and additionally thin sheet metal or strip, for example, with a yield point of 1700 $N/mm^2$ as it is usual in spring steel and with a thickness of approximately 2 mm. In that case, the levelling rolls must have a diameter which is substantially smaller than in conventional plants, for example, 45 mm, wherein, in addition, the required high torques must be introduced. Since the levelling force at the levelling rolls is smaller in the case of thinner sheet metal, there are difficulties with respect to the transport of the sheet metal ensured by the frictional contact between the levelling rolls and the sheet metal or strip.

SUMMARY OF THE INVENTION

Therefore, it is the primary object of the present invention to provide a levelling machine of the above-described type which makes it possible to avoid the difficulties occurring during levelling of high-strength, thin sheet metal and strip.

In accordance with the present invention, the above-mentioned object is met by providing intermediate rolls for driving the levelling rolls.

As a result of the configuration according to the present invention, it is possible to realize small diameters of the levelling rolls, on the one hand, while still introducing the very the high torques by connecting the drive shafts or universal joint shafts having a large diameter to the intermediate rolls which also have a corresponding large diameter. Consequently, the drive power is introduced indirectly through the intermediate rolls to the levelling rolls having a small diameter.

In accordance with another feature of the present invention, additional back-up rolls supported in the roll stands are provided for the intermediate rolls. Accordingly, the intermediate rolls are arranged between the back-up rolls supporting the indirectly driven levelling rolls and the back-up rolls which are supported in the upper or lower roll stands of the levelling machine, so that the sequence of rolls from the outside to the inside is as follows: back-up rolls, driven intermediate rolls, back-up rolls, levelling rolls.

In accordance with an advantageous further development of the invention, auxiliary rolls are arranged between the levelling rolls, wherein the auxiliary rolls have a smaller diameter than the levelling rolls. These auxiliary rolls are each arranged in the gaps between two adjacent upper or lower levelling rolls and rotate without load, i.e., without contact with the sheet metal or strip to be levelled. The auxiliary rolls serve the purpose of supporting the insertion or introduction of the sheet metal or strip to be levelled. It should be noted in this connection that levelling of strip or continuous strip material is unnecessary if the material has previously been hardened. This is because a hardened, continuously travelling strip material can no longer be adjusted, so that, in these cases, strip or sheet metal plates are being levelled.

In accordance with a preferred embodiment of the invention, the sets of levelling rolls are arranged offset relative to each other. In such an arrangement, the lower roll system or the lower roll stand is preferably displaced relative to the lower roll stand. As compared to conventional roll systems in which the upper levelling rolls are each arranged in the middle of the distance between two adjacent lower levelling rolls so as to form an isosceles triangle, this feature of the present invention makes it possible to arrange the levelling rolls at a smaller distance and, thus, a smaller graduation of an upper and a lower levelling roll arranged successively in travel direction can be adjusted. Consequently, the very small graduations or levers between successive upper or lower levelling rolls which are in engagement result in significantly higher levelling forces at the individual levelling rolls, so that an equally increased frictional contact can be achieved for the transportation of the sheet metal.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
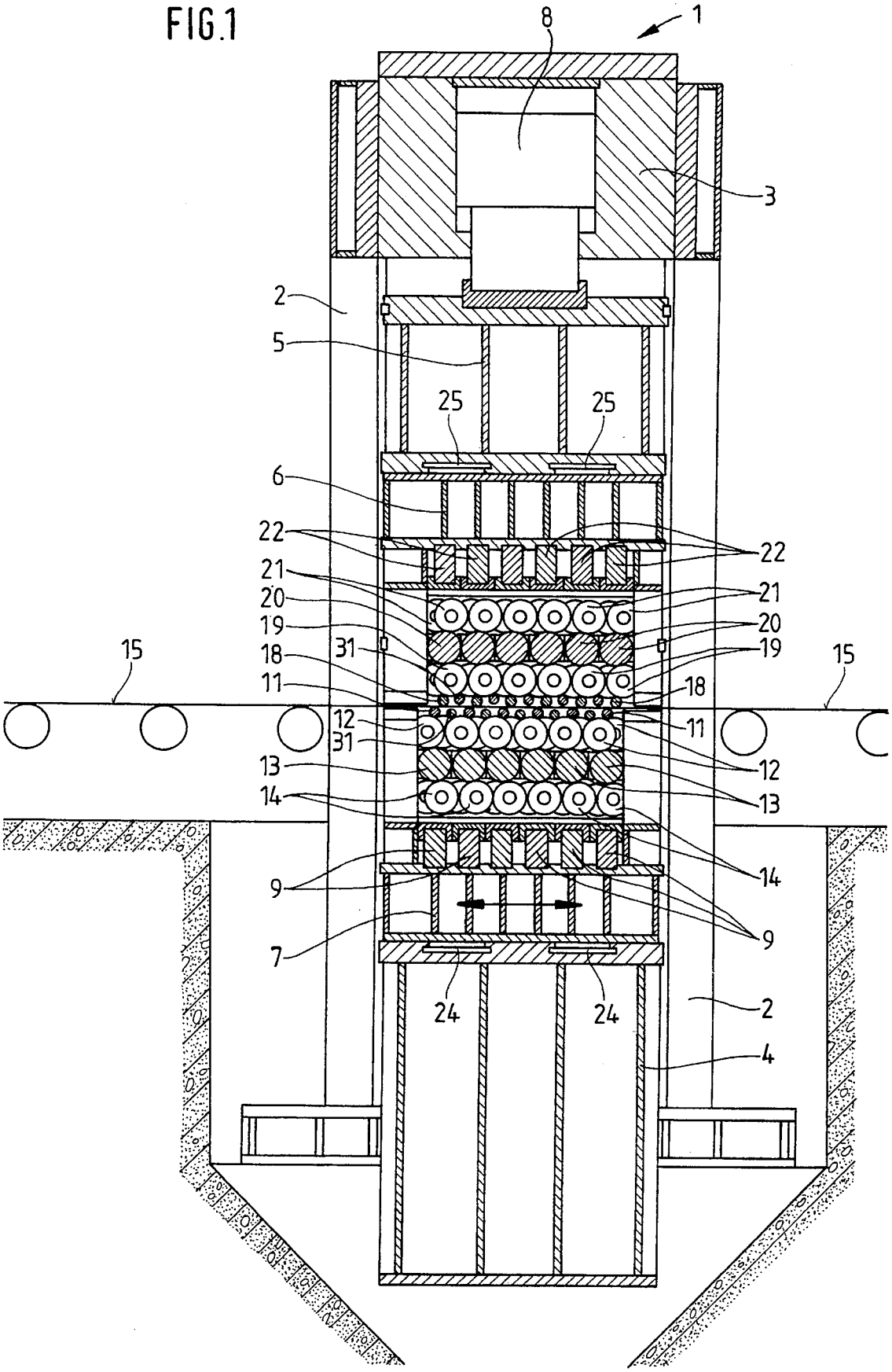
FIG. 1 is a sectional view of a levelling machine according to the present invention.

As illustrated in FIG. 1 of the drawing, a levelling machine 1 includes a machine frame composed of two pillars 2 which are anchored in a foundation. The pillars 2 are rigidly connected to each other through an upper frame crossbeam 3 and a lower transverse crossbeam 4. The upper crossbeam 5 is adjustable and supports an upper roll stand 6. A lower roll stand 7 is mounted on the lower crossbeam 4. The lower roll stand 7 is aligned relative to the crossbeam 4 by means of ledges provided on both sides of the levelling machine 1 in the travelling direction of the material being levelled. The upper crossbeam 5 is adjustable relative to the lower crossbeam 4 by means of an adjusting cylinder 8.

Figure 2:
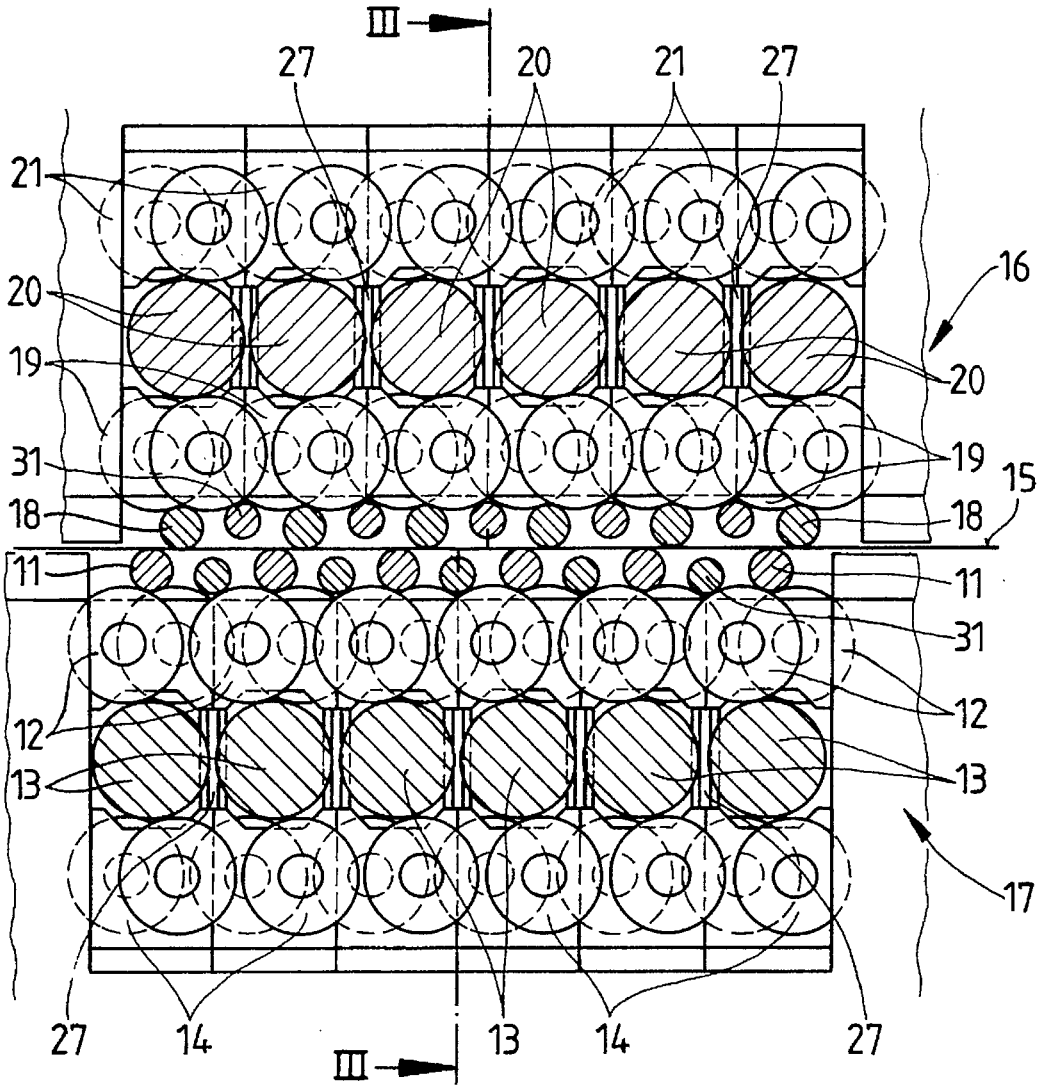
FIG. 2 shows as a detail on a larger scale the arrangement of back-up rolls and levelling rolls of the levelling machine of FIG. 1.

Roll adjusting wedges 9 are mounted on the lower roll stand 7. The roll adjusting wedges 9 can be displaced by means of pressure medium cylinders, not shown. Such a roll adjusting wedge 9 is provided for each lower levelling roll 11, for each inner back-up roll 12 supporting the lower levelling rolls 11, for the corresponding driven lower intermediate roll 13 which has a much greater diameter than the levelling roll 11, and for the outer back-up rolls 14 supporting the lower intermediate roll 13, as shown in FIG. 2.

The upper roll set 16 arranged above the levelling plane 15 is constructed in the same manner as the above-described lower roll set 17, i.e., the upper levelling rolls 18 are supported by inner back-up rolls 19, wherein driven upper intermediate rolls 20 are arranged toward the outside or toward the top of back-up rolls 19, and wherein the intermediate rolls 20, in turn, are supported by outer back-up rolls 21. The back-up rolls 21 of the upper rolls set 16 are mounted at an adjusting wedge 22. Each of the adjusting wedges 22, which are arranged adjacent to each other in a number corresponding to the number of levelling rolls 18 and intermediate rolls 20, rests with its other side against the upper roll stand 6. The adjusting wedges 22 are displaceable by means of pressure medium cylinders, not shown.

The two crossbeams 4, 5 are supported at the entry side and at the exit side relative to the roll stands 6 and 7, respectively, by means of outer fixed stops, not shown, which are arranged symmetrically relative to the machine center. In addition, as shown in FIG. 1, compensating cylinders 24 and 25 are arranged at the entry side and the exit side of the levelling machine 1. The compensating cylinders 24 are arranged between the lower crossbeam 4 and the corresponding roll stand 7 and the compensating cylinders 25 are arranged between the upper crossbeam 5 and the corresponding roll stand 6. The compensating cylinders 24 and 25 are arranged in a row between the fixed stops. The spacing between the compensating cylinders 24 is the same as the spacing between the compensating cylinders 25.

Figure 3:
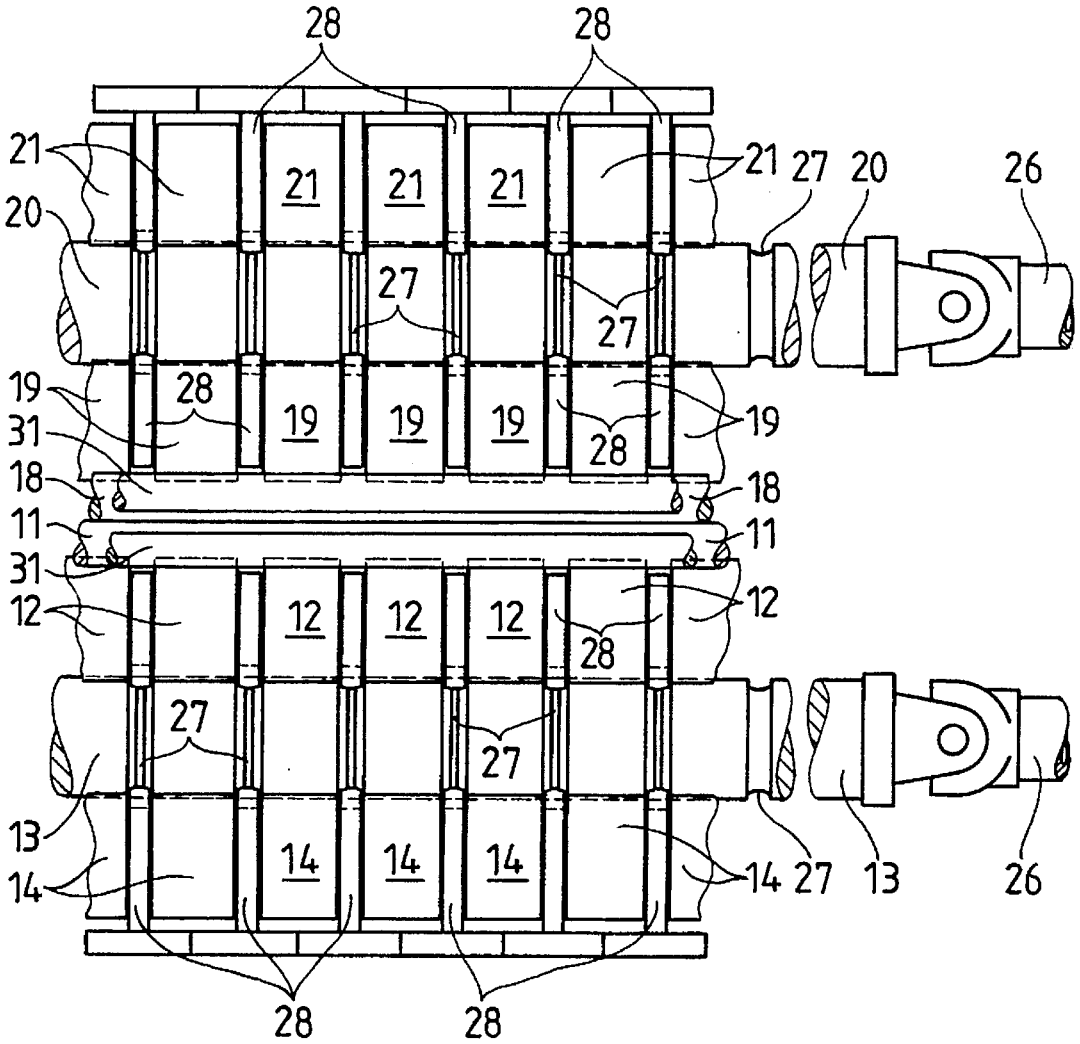
FIG. 3 is a schematic sectional view of the roll arrangement of FIG. 2 taken along sectional line III—III.

As is shown in FIG. 3, the intermediate rolls 13 and 20, which are constructed with a much greater diameter than the levelling rolls 11 and 18, are individually driven and are connected for this purpose through coupled universal joint shafts 26 to drives, not shown. The individually driven intermediate rolls 13 and 20 are provided with recesses 27 through which a medium, such as locking air, can be supplied for sealing the bearings of the inner back-up rolls 12 and 19 which are mounted with their roll axes in web plates 28.

Figure 4:
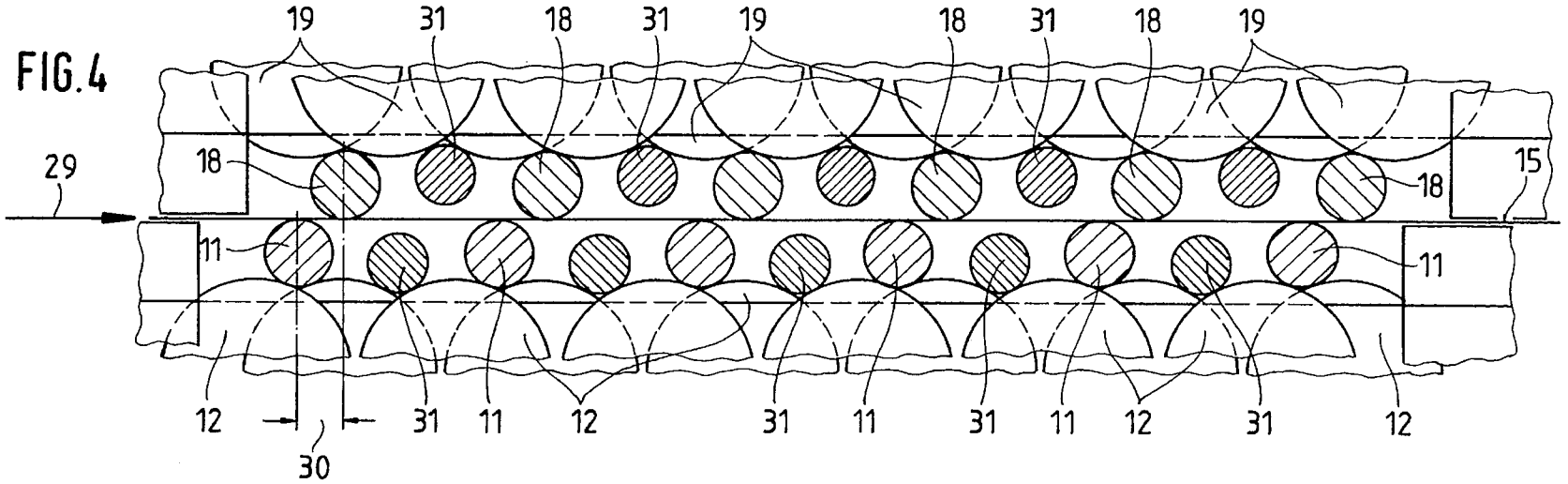
FIG. 4 is a schematic view of the upper and lower sets of levelling rolls of FIG. 2.

As shown in detail in FIG. 4, successive lower and upper levelling rolls 11 and 18 are arranged in the travel direction according to arrow 29 with a very small graduation 30 closely next to each other; this offset arrangement is not provided in levelling machines with conventional levelling roll arrangements and can be achieved by displacing the roll stand 7 supporting the lower roll set 17. The narrow graduation 30 makes it possible to significantly increase the levelling forces at the levelling rolls 11 and 18 and, thus, to ensure the frictional contact required for transporting the sheet metal or strip in the travel direction 29. This configuration also positively influences the automatic entry or introduction of the sheet metal or strip to be levelled; as an additional aid in the entry or introduction of the sheet metal or strip, narrow auxiliary rolls 31 are arranged between adjacent lower levelling rolls 11 and between adjacent upper levelling rolls 18. These auxiliary rolls 31 rotate without load and do not participate in the levelling process.

Figure 5:
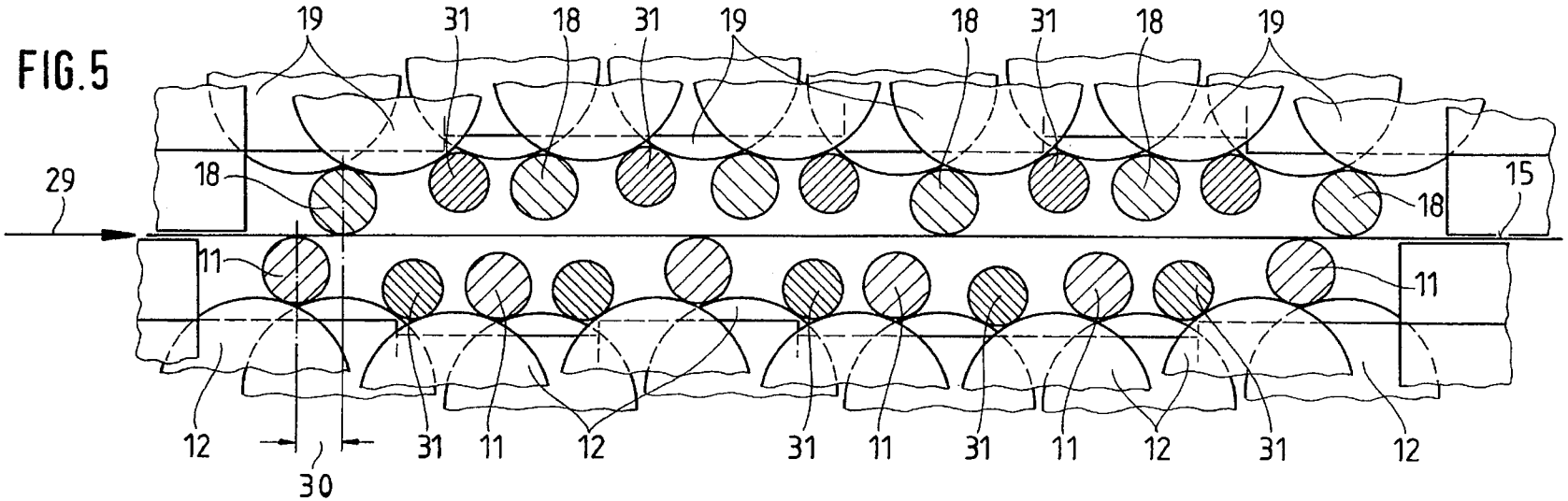
FIG. 5 is a schematic view of the levelling roll system of FIG. 4 showing the upper and lower levelling rolls which are raised and lowered, respectively, and do not participate actively in the levelling process.

As illustrated in FIG. 5, in order to expand the levelling area and to be able to level sheet metal or strip having greater thicknesses in the same levelling machine 1, the second, third and fifth upper levelling roll 18 in travel direction 29 are raised and the second, fourth and fifth lower levelling roll 11 in travel direction 29 are lowered; consequently, the raised levelling rolls 18 and the lowered levelling rolls 11 do not participate in the levelling process. As a result, the active levelling rolls 11 and 18 which remain in their initial position have much greater,graduations and because of the resulting greater lever ratios between two levelling rolls which are in engagement, smaller forces occur which make it possible to level thicker sheet metal or strip.

The invention is not limited by the embodiments described above which are presented as examples only but can be modified in various ways within the scope of protection defined by the appended patent claims.

I claim:

1. A levelling machine for levelling sheet metal or strip travelling through the levelling machine in a travel direction, the levelling machine comprising upper levelling rolls and lower levelling rolls arranged offset relative to each other in the travel direction, the levelling rolls having a length, further comprising roll stands and back-up rolls mounted in the roll stands, the levelling rolls being supported over the length thereof by the back-up rolls, further comprising individually driven intermediate rolls mounted between the levelling rolls and the back-up rolls, such that the intermediate rolls drive the levelling rolls with the levelling rolls solely driven by the intermediate rolls wherein the levelling rolls and the intermediate rolls have diameters, and wherein the diameter of the levelling rolls is substantially smaller than the diameter of the intermediate rolls.

2. The levelling machine according to claim 1, comprising additional back-up rolls mounted in the roll stands between the levelling rolls and the intermediate rolls for supporting the intermediate rolls.

3. The levelling machine according to claim 1, comprising auxiliary rolls mounted in the travel direction between the levelling rolls, wherein the auxiliary rolls have a diameter, and wherein the diameter of the auxiliary rolls is smaller than the diameter of the levelling rolls.

4. The levelling machine according to Claim 1, wherein the levelling rolls are arranged in sets, and wherein the set of the upper levelling rolls is arranged offset relative to the set of lower levelling rolls.

* * * * *